United States Patent [19]

Weisbrod et al.

[11] Patent Number: 5,072,669

[45] Date of Patent: Dec. 17, 1991

[54] INKING UNIT

[75] Inventors: Norbert Weisbrod, Hessheim; Norbert Köbler, Beindersheim, both of Fed. Rep. of Germany

[73] Assignee: Albert-Frankenthal AG, Frankenthal, Fed. Rep. of Germany

[21] Appl. No.: 659,459

[22] Filed: Feb. 21, 1991

Related U.S. Application Data

[63] Continuation of Ser. No. 290,151, Dec. 27, 1988, abandoned.

[30] Foreign Application Priority Data

Jan. 9, 1988 [DE] Fed. Rep. of Germany ..... 3800119

[51] Int. Cl.[5] ..... B41F 31/04; B41F 31/06; B41L 27/10

[52] U.S. Cl. ..... 101/142; 101/363; 101/366

[58] Field of Search ..... 101/350, 363, 366, 364, 101/207-210, 148, 142, 351, 352; 118/412, 413

[56] References Cited

U.S. PATENT DOCUMENTS

| | | | |
|---|---|---|---|
| 2,151,969 | 3/1939 | Henderson | 101/366 X |
| 2,177,656 | 10/1959 | Kaddeland | 101/366 X |
| 3,339,485 | 9/1967 | Rytterholm | 101/363 |
| 3,759,175 | 9/1973 | Alsop | 101/366 |
| 3,899,999 | 8/1975 | Christ et al. | 101/366 |
| 3,987,724 | 10/1976 | Zimmer | 101/366 |
| 4,009,657 | 3/1977 | Bonanno et al. | 101/366 |
| 4,414,900 | 11/1983 | Kraus et al. | 101/364 |
| 4,455,938 | 6/1984 | Loudon | 101/363 |
| 4,590,855 | 3/1986 | Schommer et al. | 101/350 |
| 4,625,643 | 12/1986 | Davis | 101/366 |
| 4,688,516 | 8/1987 | Sommer | 118/413 |

FOREIGN PATENT DOCUMENTS

| | | | |
|---|---|---|---|
| 3704433 | 8/1988 | Fed. Rep. of Germany . | |
| 0062152 | 4/1984 | Japan | 101/366 |
| 2158371 | 11/1985 | United Kingdom | 118/413 |

*Primary Examiner*—J. Reed Fisher
*Attorney, Agent, or Firm*—Edwin D. Schindler

[57] ABSTRACT

In the context of a printing press inking unit with at least one pitted roll cooperating with two doctor blades offset from each other in the circumferential direction of the pitted roll and preferably carried on a mount so as to define an ink chamber between them into which the pitted roll extends, the wear of the doctor blade removing debris from the pitted roll is reduced if there is a forechamber outside the blade which is upstream in terms of the direction of rotation of the pitted roll, such roll dipping into such forechamber.

12 Claims, 1 Drawing Sheet

INKING UNIT

This application is a continuation of application Ser. No. 07/290,151, filed Dec. 27, 1988, now abandoned.

BACKGROUND OF THE INVENTION

The invention relates to an inking unit, more particularly to an inking unit with a short ink path from the ink source to the printing image carrier to be inked such as the plate of an offset litho press, comprising an ink chamber doctor arrangement with two doctor blades which are offset in relation to each other in the peripheral direction of a pitted roll with which they cooperate and which are preferably mounted on a blade holder, so that the blades define an ink chamber between them into which the pitted roll extends.

The peripheral section the pitted roll moving away from the roll arranged after the pitted roll, which in the case of inking units with a short ink path is always the form roll, not only lacks a complete ink film but is usually covered with foreign matter such as fount solution, which has made its way into the inking unit, and the like. There is thus a danger of the doctor blade which is to the rear in the direction of pitted roll and which has to clear the foreign matter from the pitted roll functioning as a leading or closing doctor, being subject to a comparatively high wear rate, since the foreign matter, more especially the dampening solution, has an extraordinarily powerful wear accelerating effect.

SHORT SUMMARY OF THE INVENTION

Accordingly one object of the present invention is to devise an inking unit of the initially mentioned type which is so improved upon that the doctor blade functioning as the leading or sealing blade, is protected against wear.

A further aim of the invention is to provide such an inking unit incorporating this improvement at the least possible cost and using the simplest possible means.

In order to achieve these or other objects appearing from the present specification and claims, the inking unit is so designed that in front of the ink chamber there is forechamber which is adapted to receive ink and is arranged in front of the main ink chamber clear of the leading or closing doctor blade on the upstream side in the direction of rotation of the pitted roll and into which the pitted roller extends.

The application of ink to the pitted roll effected at the forechamber ensures that the doctor blade which is liable to wear because of the foreign matter to be removed, receives ink along its entire length, this ensuring smooth running even if the doctor blade is set at an angle favoring wear. The invention thus makes it possible to ensure a long working life of the doctor even if the upstream doctor blade is set at a negative angle.

In accordance with an advantageous further development of the invention it is possible for the forechamber to be supplied with ink via at least one transfer port from an ink chamber in which the ink is preferably subjected to a gage pressure. This means that no separate ink supply is needed for the forechamber, and in fact the excess ink emerging from the ink chamber may be used for pre-inking the pitted roll. This feature leads to a simple design.

In accordance with a particularly simple design in accordance with the invention there is an advantage if the forechamber is only separated by the upstream doctor blade from the ink chamber and at this doctor blade and/or the mounting means thereof there is at least one transfer port.

It is convenient if the forechamber is provided with an ink overflow which may simply be formed by providing a sheet metal baffle which does not make contact with the pitted roll, in order to delimit the forechamber. These features not only lead to a low wear rate in operation adjacent to the sheet metal baffle, but also simultaneously prevent the build up of an excessively high gage pressure. Even so the ink flowing out of the forechamber ensures a reliable pre-inking of the pitted roll.

Further advantageous features and convenient developments of the invention will be seen from the ensuing account of a working example with reference to the drawing and from the claims.

LIST OF THE FIGURES OF THE DRAWINGS

DESCRIPTION OF WORKING EMBODIMENT OF THE INVENTION

Figure 1:
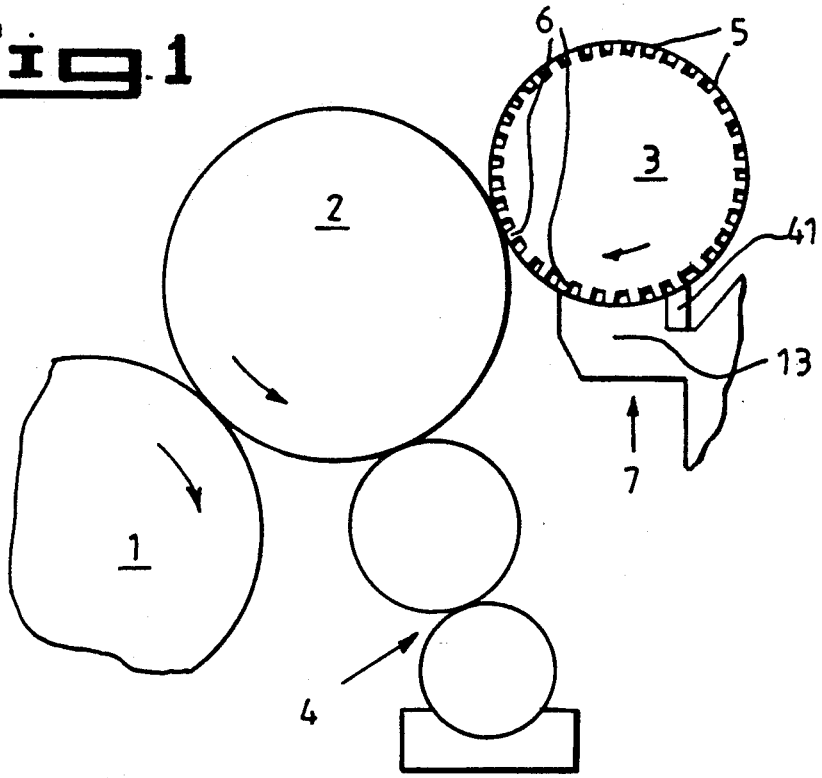
FIG. 1 shows diagrammatically an inking unit in accordance with the invention having a short ink path.

The short inking unit, that is to say the inking unit with a short ink path, in accordance with the invention is made up of a rubber form roll 2 on the plate cylinder 1 adapted to carry a hard offset litho plate. The plate cylinder and the form roll have the same diameter. The form roll is tended by a pitted roll 3 having a smaller diameter. In the case of the offset litho press in the present instance the form roll 2 simultaneously cooperates with a dampening unit generally referenced 4. The periphery of the pitted roll 5, which may have a ceramic coating, is provided with the pits 4, shown on an exaggerated scale in FIG. 1, such pits being separated by lands 5. The pits 5 are filled with ink and the lands 6 are cleared by the doctor so that there is a exact control of the inking rate depending on the capacity of the pits 5.

Figure 2:
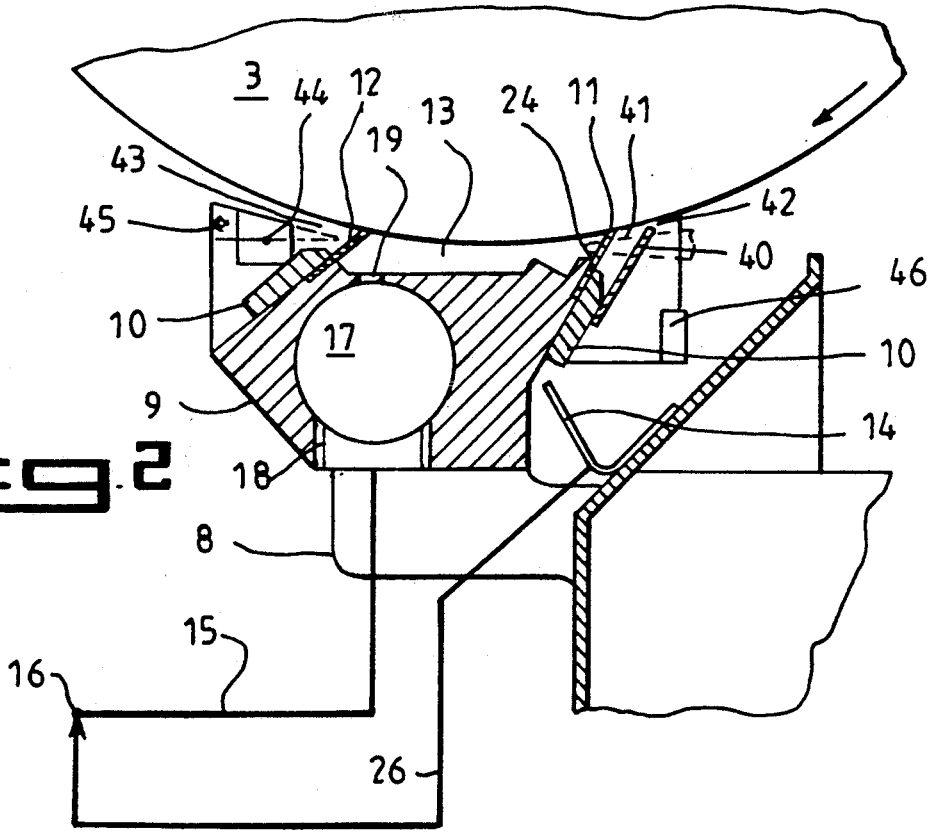
FIG. 2 is a radial section taken through a chamber doctor arrangement in accordance with the invention associated with a pitted roll.

The supply of the ink to the pitted roll 3 and the removal of ink therefrom are performed by means of an ink chamber doctor arrangement which is generally referenced 7 in FIG. 1 and comprises, as may best be seen from FIG. 2, an ink chamber 13 delimited by two mutually offset doctor blades 11 and 12 and a forechamber 41 arranged in front thereof, that is to say upstream from the ink chamber 13. Along the length of the doctor roll 3 it is possible to provide a number of adjacent ink chamber doctor arrangements 7, as for example two, which each occupy half the length of roll. However it would also be possible to have for instance one ink chamber doctor arrangement 7 for the breadth of each offset plate carried on the plate cylinder 1. The use of a number of adjacently placed ink chamber doctor arrangements 7 facilitates operation of the press and makes it possible for supply of ink to the pitted roll 3 to be discontinued in zones.

As will furthermore be seen from FIG. 2, the ink chamber doctor arrangement 7 comprises a doctor mount 9 in the form of a beam and which may be carried on supports 8 fixed to the press frame. The two doctor blades 11 and 12, which are offset in relation to each other in the direction of rotation of the pitted roll 3, are secured to this doctor mount 9. The doctor blade 11 and 12 are held by means of jaws 10, for which purpose the jaws may be adapted to grip the respectively associated doctor blade against the doctor mount 9. In the illustrated working example of the invention the jaws 10 together with the doctor mount 9 are intended to form a respective receiving slot, into which the respectively associated doctor blade is fitted without any gripping action, that is to say loosely. For this purpose the clearance width of the receiving slot is made three or four hundredths of millimeter oversize. The result of this is that if the doctor blades are heated, as is more especially the case with offset ink, the blades are free to expand sideways and even if the blades are only lightly pressed against the pitted roll and otherwise gently treated bending of the blades in the form of corrugations is avoided and it possible to ensure reliable engagement of the doctor blades. In the illustrated working example of the invention the two doctor blades 11 and 12 are set at a negative angle, that is to say, they are set so that they make an obtuse angle with the part of the circumference of the pitted roll 3 which is to be back of them. If the system is to be designed so that the direction of rotation of the pitted roll may be reversed it would be possible to have a symmetrical, roof-like arrangement of the doctor blades, in which respect only the doctor blade to the fore in the direction of rotation of the pitted roll 3 would be set at negative angle.

The two mutually offset doctor blades 11 and 12 form the rear and front limits of the ink chamber 13, that is to say rear and front in terms of the direction of rotation of the roll 3, and the radial limits of the chamber are formed by the doctor mount 9 and the periphery of the pitted roll 3. At the ends ink chamber 3 and the forechamber 41 are shut off by the sealing cheekpieces 34 resting against the ends of the doctor blades 11 and 12. The latter are formed by pieces of sheet metal able to be inserted into guides 46 on the doctor mount which holds the edges of the sheet metal. The clearance width of the guides is made sufficiently oversize in the length direction of the doctor blades 11 and 12 to enable same to expand. In order to ensure reliable engagement of the sealing cheekpieces 43 with the ends of the doctor blades 11 and 12 and, respectively, a delimitation of the forechamber 41 the sealing cheekpieces 43 have supporting finger-like carriers 44 behind them, which in the longitudinal direction of the doctor blades are borne on the doctor mount 9 in a resilient manner as is indicated at 45.

The ink chamber 13 is supplied with ink and for this purpose the doctor mount 9 is provided with a distributing header 17 formed by an axial hole from which there extend a number of feeders 19 which are evenly spread out along the length of the doctor mount 9 and open into the ink chamber 13. The distributing header 17 is connected by means of a connecting hole 18 with a supply pipe 15 leading to an ink pump 16. In the illustrated example of the invention the ink is to be fed to the ink chamber 13 with a slight gage pressure so that the pitted roll 3 may be reliably supplied with ink without any other means being needed. It would however also be possible to arrange a fountain roll in the ink chamber 13 to cooperate with the pitted roll 3. In this case it would be possible to dispense with gage pressure and accordingly with a complete filling of the ink chamber 13.

The forechamber 41 is also fed with ink and for this purpose the it may be provided with its own ink supply means. In the present case the forechamber 41 is supplied with excess ink coming from the ink chamber 13. In order to limit the gage pressure obtaining in the ink chamber 13 the latter is provided with overflow ports 24 via which it is possible for the ink to be discharged so that it may be returned to the pump 16 and the ink is circulated. These overflow ports 24 may, as will furthermore be seen in FIG. 2, be in the form of cylindrical recesses, which are spaced from the doctor edge, in the upstream doctor blade 11, which functions as the upstream or closing doctor. In addition or as an alternative to these recesses in the doctor blade 11 it is however also possible to have slots, arranged in the doctor blade mount, as transfer ports. In order to ensure maximum evenness of supply to the forechamber 41 along its entire length there are transfer ports 24 evenly distributed out along the length.

The forechamber 41 is delimited by a sheet metal baffle 40 arranged generally in parallelism to the adjacent doctor blade 11 and which is clear of the periphery of the pitted roll 3. The edge of the baffle 40 nearest the roll thus forms an overflow edge defining an outlet slot 42. The baffle 40 may be formed as part of the doctor mount 9, as part of the closing cheekpieces 10 or, as in the present case, mounted thereon.

Ink entering the forechamber 41 via the transfer ports 24 is accumulated. The excess ink may flow out at the outlet gap 42 from the forechamber 41 so that only a complete filing of the forechamber 41 is guaranteed but there is no possibility of the build up of an excess pressure. The discharge gap 42 has a drain gutter 14 fitted under it which catches the drops of excess ink. There is a return duct 26 running from the drain gutter 14 to a ink supply tank or direct to the ink pump 16.

The outer surface of the pitted roll 3 dipping into the forechamber 41 on which deposits of solidified ink, particles of dust in the pits and the like may accumulate, is pre-inked at the forechamber 41, filled with ink, along its entire length. The entire coating so applied is stripped off by the doctor blade 11 following the forechamber 41. Owing to the previous complete inking of the pitted roll 3 the wear of the doctor blade 11 which in previous designs was caused by foreign matter on the roll, and more especially by the dampening fluid, is prevented or considerably reduced.

The pre-inked pitted roll stripped by the doctor blade 11 is finally inked in the ink chamber 13 which is under a slight gage pressure, that is to say the pits 5 are topped up where necessary. At the outlet of the ink chamber 13 the lands 6 are wiped clean by the doctor blade 12 placed upstream. This blade is accordingly termed the working blade. On the other hand the opposite doctor blade is termed the upstream or closing doctor. In the working example shown the two doctor blades 11 and 12 are set at a negative angle as already mentioned. In this case the system is operated with a constant direction of rotation of the pitted roll 3 so that there is only one forechamber 41 adjacent to the doctor blade acting as the upstream or closing doctor. If the direction of the pitted roll 3 is to be reversed it would be possible to have forechambers adjacent to both doctor blades in such a way that the forechamber which is not required would not be supplied with ink. This would be ensured by only having the doctor blade adjacent to the forechamber required fitted with transfer ports.

We claim:

1. A printing apparatus, comprising:

an offset printing press having an inking unit as a part of said offset printing press, said inking unit including:

a pitted roll;

a first doctor blade and a second doctor blade, said doctor blades being arranged to cooperate with the periphery of said pitted roll and which are mutually offset about such periphery, said doctor blades defining an ink chamber into which said pitted roll is arranged to extend, said first doctor blade being an upstream closing blade and acting as means for producing a substantially clean, or blank, surface;

an ink forechamber being defined outside said first doctor blade upstream from said ink chamber into which forechamber said pitted roll extends, wherein said first doctor blade serves to separate said ink forechamber from said ink chamber and wherein at least one transfer port is provided adjacent to a portion of said first doctor blade; and, means adapted to supply said ink chamber through at least one transfer port leading to said ink forechamber.

2. The printing apparatus according to claim 1, wherein the at least one transfer port which is provided adjacent to a portion of said first doctor blade is at least partially adjacent a mount of said first doctor blade.

3. The printing apparatus according to claim 1, wherein said first doctor blade is provided with recesses in order to form transfer points.

4. The printing apparatus according to claim 3, wherein the recesses of said first doctor blade are distributed equally along the length of said first doctor blade.

5. The printing apparatus according to claim 1, wherein said forechamber is provided with an ink overflow and further comprising a sheet metal baffle delimiting said forechamber and spaced from said first doctor blade which is adjacent thereto with the end of said baffle nearer said pitted roll forming an overflow edge clear of said pitted roll, said ink overflow being formed by the spacing between said overflow edge and said pitted roll.

6. The printing apparatus according to claim 5, further comprising a drain gutter under a discharge gap defined by said sheet metal baffle.

7. The printing apparatus according to claim 6, wherein said drain gutter is connected via a return pipe leading to an ink tank.

8. The printing apparatus according to claim 6, wherein said drain gutter is connected via a return pipe leading to an ink pump.

9. The printing apparatus according to claim 1, further comprising a doctor mount having at least one slot therein to receive one of said doctor blades with a loose fit.

10. The printing apparatus according to claim 9, wherein said doctor mount has at least one slot therein in order to receive said first doctor blade.

11. The printing apparatus according to claim 1, wherein at least said second doctor blade is arranged to engage said pitted roll with a negative angle.

12. The printing apparatus according to claim 11, wherein said first doctor blade and said second doctor blade are arranged to engage said pitted roll with a negative angle.

* * * * *